United States Patent [19]

Oakley et al.

[11] 4,099,808

[45] Jul. 11, 1978

[54] UPRIGHT VAULT-LIKE STEEL CABINET FOR GUNS AND VALUABLES

[75] Inventors: Ervin Carvis Oakley; George Robert Bell; William Eugene Poole, all of Winston Salem, N.C.

[73] Assignee: ECO Industries, Inc., Winston Salem, N.C.

[21] Appl. No.: 822,424

[22] Filed: Aug. 8, 1977

[51] Int. Cl.[2] ..... A47B 49/00; E05G 1/00; A47F 3/10

[52] U.S. Cl. ..... 312/138 R; 109/50; 49/380; 211/64; 312/217; 312/252

[58] Field of Search ..... 312/135, 138 R, 217, 312/222, 252, 305; 211/64; 109/50, 52, 70; 49/380

[56] References Cited

U.S. PATENT DOCUMENTS

| | | | |
|---|---|---|---|
| 2,927,352 | 3/1960 | Chenoweth | 49/380 |
| 3,762,789 | 10/1973 | Robertson | 211/64 |
| 3,848,940 | 11/1974 | Berens | 211/64 |
| 3,920,297 | 11/1975 | Brandes | 312/217 |
| 3,927,923 | 12/1975 | Kimmel | 211/64 |
| 4,043,279 | 8/1977 | Padgett | 109/50 |

*Primary Examiner*—Casmir A. Nunberg

*Attorney, Agent, or Firm*—Bell, Seltzer, Park & Gibson

[57] ABSTRACT

A security cabinet designed for use in the home for storage of guns or other valuable articles includes an upright generally rectangular enclosure of plate steel construction having an open front and with a rectangular door frame weldably secured to the walls of the enclosure at the open front side thereof to reinforce and strengthen the enclosure and provide a strong and unyielding supporting frame surrounding the door. A door, also of plate steel construction, is hingedly mounted in the door frame by recessed hinges which are located interiorly of the enclosure and inaccessible to tampering when the door is in the closed position. A locking bracket is welded to the door frame and has a portion which extends through an opening provided in the door and to which a lock is fastened for securing the door in the closed position. A gun rack is provided inside the cabinet, the gun rack being rotatably mounted to provide ready access to all of the guns inside the cabinet.

15 Claims, 10 Drawing Figures

UPRIGHT VAULT-LIKE STEEL CABINET FOR GUNS AND VALUABLES

This invention relates to a cabinet particularly designed for use in the home for storage of guns or other valuable articles.

Hunting enthusiasts and gun collectors usually have a very sizable investment in the rifles, shotguns and pistols in their collections. However, most home-owners do not have a suitable place to store expensive firearms where they are secure against thieves and inaccessible to children. Thus the need exists for a cabinet suitable for use in the home and where guns or other valuables can be securely stored. While various kinds of cabinets have been proposed in prior patents or sold commercially, the devices heretofore known or available do not provide the degree of security really needed for protecting guns and valuables. While most of these cabinets do provide some way for locking the guns or valuables, they are, for the most part, susceptible to tampering or forcible entry by professional burglars intent on stealing the guns or valuables contained therein.

With the foregoing in mind, it is a primary object of this invention to provide a security cabinet for storage of guns or other valuables which provides for greater security than has been heretofore available.

More particularly, it is a primary object of this invention to provide a cabinet for the storage of guns or other valuables and which is particularly designed to have enhanced security against forced entry.

It is a further object of the invention to provide a security cabinet having a versatile interior configuration to permit storing guns or valuables therein a number of different arrangements.

SUMMARY OF THE INVENTION

In accordance with this invention a security cabinet is provided which is of heavy steel construction and includes an upright generally rectangular enclosure having a open front with the walls thereof being welded together at their proximal edges along the corners of the enclosure and with a rectangular door frame weldably secured to the walls at the front of the enclosure. The door frame is formed of weldably connected U-shaped channel members with one of the legs of each of the channel members being welded to the adjacent plate steel wall of the rectangular enclosure and the other legs of the channel members collectively defining the doorway opening. The door frame thus serves to reinforce and strengthen the enclosure while providing a very strong and unyielding supporting frame surrounding the door.

The door is of plate steel construction and is positioned in the door frame flush with the outer face of the door frame and with the periphery of the door closely conforming with the doorway opening defined by the door frame. The flush mounting of the door and the close tolerance between the door and the door frame makes it exceedingly difficult for someone to insert a tool between the door and the door frame to pry or force the door open. The door is hingedly secured to the frame by recessed hinges which are located interiorly of the enclosure and thus inaccessible to tampering when the door is in the closed position.

A locking bracket is weldably secured to the side channel member of the door frame located opposite the hinges and has a portion which extends inwardly from the channel member and other portions which extend forwardly into the doorway and through an opening provided in the door. Locking means cooperate with the portion of the locking bracket which extends through the door opening to thereby secure the door in the locked position.

A rotatable gun rack is provided inside the cabinet, the gun rack including an elongate upright shaft which is rotatably mounted to the upper and lower walls of the enclosure, and a circular gun butt support carried by the shaft adjacent the lower end thereof and adapted for rotation therewith in the enclosure. The gun butt support includes a series of spaced recesses in the upper face thereof extending around the periphery of the circular support for receiving and supporting the butt portions of respective guns therein. The circular gun butt support is of a diameter substantially corresponding to the inside dimensions of the enclosure so as to thereby extend substantially across the enclosure with forwardmost portions of the circular gun butt support overlying the bottom channel member of the rectangular door frame. The gun rack also includes a gun barrel support carried by an upper portion of the shaft for rotation therewith in the enclosure, the gun barrel support being of smaller dimensions than the gun butt support and having a series of recesses formed in the periphery thereof adapted for supporting the barrels of respective guns positioned therein.

Some of the objects, features and advantages of the invention having been stated, others will become apparent as the description proceeds when taken in connection with the accompanying drawings, in which FIG. 1 is an isometric view of a security cabinet in accordance with this invention shown with the door closed;

Figure 1:
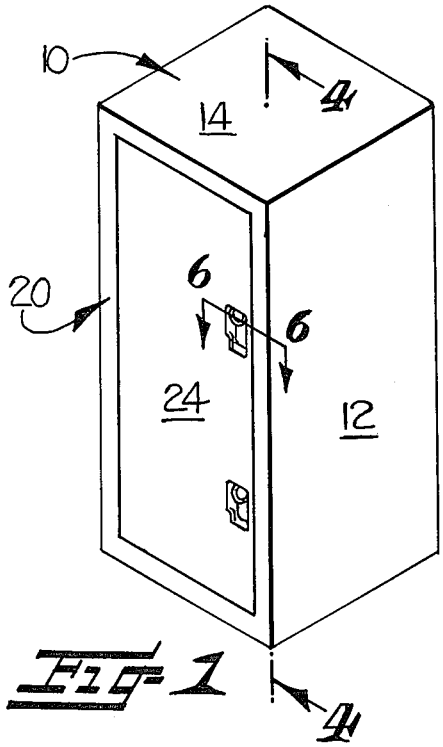
Figure 2:
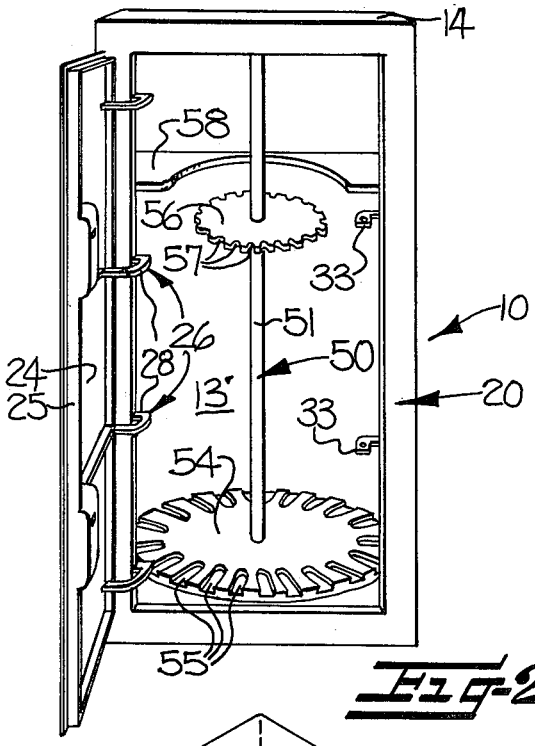
FIG. 2 is a front perspective view of the cabinet shown with the door open to reveal the rotatable gun rack provided inside the cabinet.

Referring now more particularly to the drawings, the security cabinet illustrated includes an upright enclosure, generally indicated by the reference character 10, which is of plate steel construction and comprises opposing rectangular side walls 11, 12, a rectangular rear wall 13, and generally square upper and lower walls 14, 15. All of the walls are of heavy gauge plate steel construction of such a thickness as to be exceedingly difficult to bend or cut with the tools normally carried by a burglar. Preferably, the walls are of seven gauge plate steel. The walls are welded together at their proximal edges along the corners of the enclosure to form an upright box-like structure with an open front. Holes 16 are preferably provided in the bottom wall 15 to permit securing the cabinet to the floor and thereby preventing unwanted movement or theft of the entire cabinet.

A rectangular door frame, generally indicated by the reference character 20, is weldably secured to the enclosure at the open front side thereof. The door frame 20 is formed of heavy U-shaped cross-section channel members which are weldably secured to form a very strong and rigid frame. The channel members have respective legs 21, 22 (FIG. 3) with an inter-connecting web portion 23 extending therebetween. The outer legs 21 of the respective channel members are welded to the respective inner faces of the side walls 11, 12 and upper and lower walls 14, 15 with the inner legs 22 of the channel members collectively defining the doorway opening and with the inter-connecting web portions 23 of the channel members defining the outer face of the door frame. A door 24, also of heavy gauge plate steel construction, is positioned in the door frame with the outer face of the door being flush with the outer face of the door frame and with the periphery of the door closely conforming with the doorway defined by the door frame. Preferably, door 24 is sixed to very close tolerances with the dimensions of door frame 20 to make it exceedingly difficult to insert a prying tool between the door and the door frame to force or bend the door. The door also includes a peripheral reinforcing frame 25 on the inner face thereof, the reinforcing frame 25 being formed of heavy gauge bar stock and weldably secured to the inner face of the door adjacent the peripheral edges thereof. As illustrated, the reinforcing frame is preferably inset a short distance, e.g., about one-fourth inch, from the peripheral edge of the door.

Figure 9:
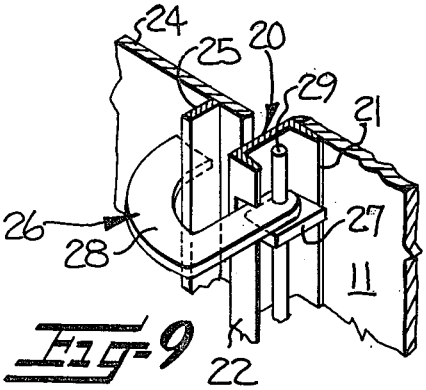
FIG. 9 is a fragmentary detail isometric view showing details of the hinge construction and shown with the door in the open position.
Figure 10:
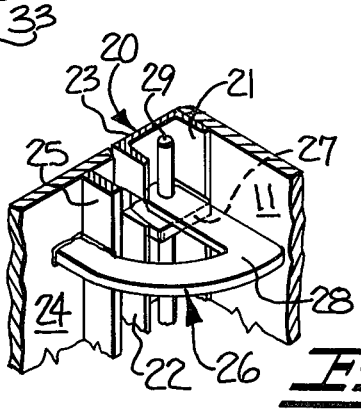
FIG. 10 is a view similar to FIG. 9 but with the door in the closed position.

The door 24 is hingedly mounted to the door frame 20 by a series of four hinges 26 which, as is readily apparent from the drawings, are of recessed construction and located interiorly of the enclosure and thus inaccessible to tampering when the door is closed. Each hinge 26 includes a rectangular mounting block 27 (FIG. 9) which is weldably secured between the opposing legs 21, 22 of one of the side channel members of door frame 20. Each hinge 26 also includes an elongate curved arm 28 which is pivotally mounted to the mounting block 27 and extends inwardly of the enclosure a predetermined distance and then outwardly in an arcuate manner toward the doorway with the outer ends of the pivotally mounted arms 28 being welded to the door reinforcing frame 25. Preferably, the curved arms 28 extend inwardly of the door a distance of at least twice the length of the legs of the door frame channel member. This serves to provide adequate clearance for the recessed hinge around the side channel member, and further beneficially serves to position those portions of the arm located in direct alignment with the narrow gap between the door and the door frame a considerable distance inwardly of the door. This minimizes the possibility of someone successfully cutting the arms 28 by inserting a blade into the narrow gap between the door and the door frame. The inner legs 22 of the side channel member are notched to receive the arms 28 when the door is swung to its wide open position.

The arms are pivotally secured to the mounting blocks by means of an elongate shaft 29 which extends longitudinally through the respective mounting blocks 27 and their cooperating arms 28. The shaft 29 is weldably secured to the uppermost and lowermost arms to prevent longitudinal shifting of the shaft. Referring more particularly to the hinge construction, it will be noted that the uppermost arm and the lower of the two intermediate arms are positioned overlying their respective mounting blocks 27 and are supported thereby. These arms thus serve for bearing the weight of the door while also hingedly securing the door to the door frame. The lowermost arm and the upper of the two intermediate arms are positioned beneath their respective mounting block and serve to assist in hingedly securing the door to the door frame and to also prevent moving the door vertically upwardly when in the open condition. This arrangement of the arms with their respective mounting blocks permits the same door frame to be used in the construction of either a right or a left-hand hinged door merely by inverting the door frame when assembling the frame 20 with the enclosure 10.

The door also includes a pair of generally rectangular recesses located adjacent the side of the door opposite the hinges. The recesses, more particularly, are defined by respective generally rectangular openings formed in the plate steel door with a rectangular plate steel box 30 weldably secured to the inner face of the door behind the rectangular opening. As illustrated, a portion 31 of the plate steel door 24 extends beyond the side of the rectangular box 30 to define an overlapping handle portion to facilitate grasping and opening the door. A rectangular opening 32 is located in the back wall of the rectangular box 30 for purposes which will become apparent hereinafter.

Figure 6:
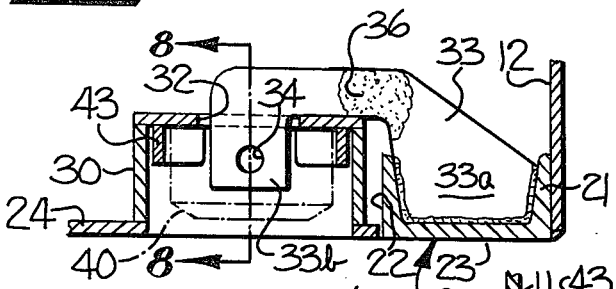
FIG. 6 is a sectional detail view taken substantially along the line 6—6 of FIG. 1 and showing the details of the locking mechanism.
Figure 8:
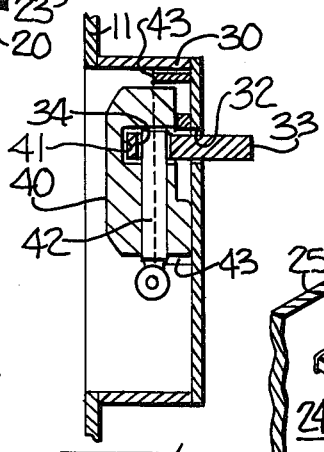
FIG. 8 is a detailed sectional view of the locking mechanism taken substantially along the line 8—8 of FIG. 6 and shown with the lock in position on the locking bracket.

The door is locked in the closed position by means of respective locking brackets 33 carried by the side door frame channel member opposite the hinges. As illustrated in FIG. 6, the locking brackets 33 are of generally U-shaped configuration with one end portion **33*a* being positioned between the opposing legs 21, 22 of the channel member and weldably secured thereto and with portions extending inwardly therefrom and then outwardly into the doorway with the free end portion 33*b* of the locking bracket being positioned to extend into the doorway and through the rectangular opening in the door. The locking brackets 33 also serve as an abutment stop to limit inward movement of the door. As best illustrated in FIG. 6, the upper and lower surface portions of each locking member 33 located directly behind the edge of the door 24 is built up and reinforced with an applied layer of a facing material 36 having a degree of hardness considerably greater than that of the steel plate which forms the locking bracket. The facing material 36 is commercially available in rod form and is fusion bonded to the selected areas of the locking bracket 33 using an electric arc, torch, or other suitable means. The facing material 36 is of such a hardness as to be nearly impossible to cut using conventional cutting blades, and thus serves to prevent cutting the locking brackets to gain access into the cabinet in the event a saw blade were inserted into the narrow gap between the door and door frame. A hole 34 is provided in the free end portion 33*b*** of the locking bracket through which a lock may be secured to thereby lockingly secure the door in the closed position.

Figure 7:
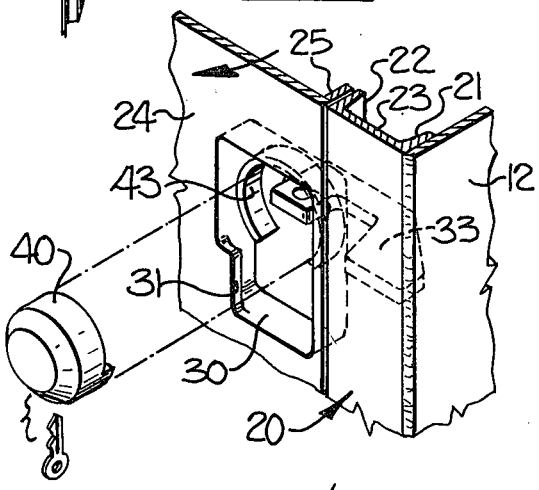
FIG. 7 is a fragmentary front isometric view showing details of the locking mechanism.

While any number of kinds of locks may be suitably employed, such as a conventional padlock for example, the shackle portion of most conventional padlocks is susceptible to being cut by a strong bolt cutter or a hacksaw. Therefore, the preferred form of the invention illustrated herein provides a unique and essentially tamper-proof locking arrangement for the door. More particularly, the preferred lock utilized in accordance with this invention is of a shackleless type and is thereby exceedingly difficult to remove by force or cutting. The lock, sold under the name "American Series 2000" has a reinforced flat cylindrical body 40 with a recess 41 formed in one of the flat surfaces thereof adapted for receiving the free end portion 33*b* of the locking bracket which extends through the opening 32 in the door 24. A key-operated rectractable bolt 42 located inside the reinforced flat cylindrical body 40 is positioned for extending across the recess 41 in the body and through the hole 34 provided in the free end portion 33*b* of the locking bracket positioned in the recess 41 to thereby lockingly secure the lock to the locking bracket. In addition, as best seen in FIG. 7, a circular collar 43 of steel construction is weldably secured to the rear wall of the rectangular box 30. Circular collar 43 is of a diameter adapted to receive the cylindrical body 40 of the lock. The collar 43 thus serves to shield the lock and to prevent inserting a tool behind the lock in an attempt to pry the lock outwardly to remove it from the door. Further, the collar 43, together with the recessed location of the lock in the door make it exceedingly difficult, if not impossible, to reach the lock with a saw blade for purposes of removing the lock by cutting.

Figure 3:
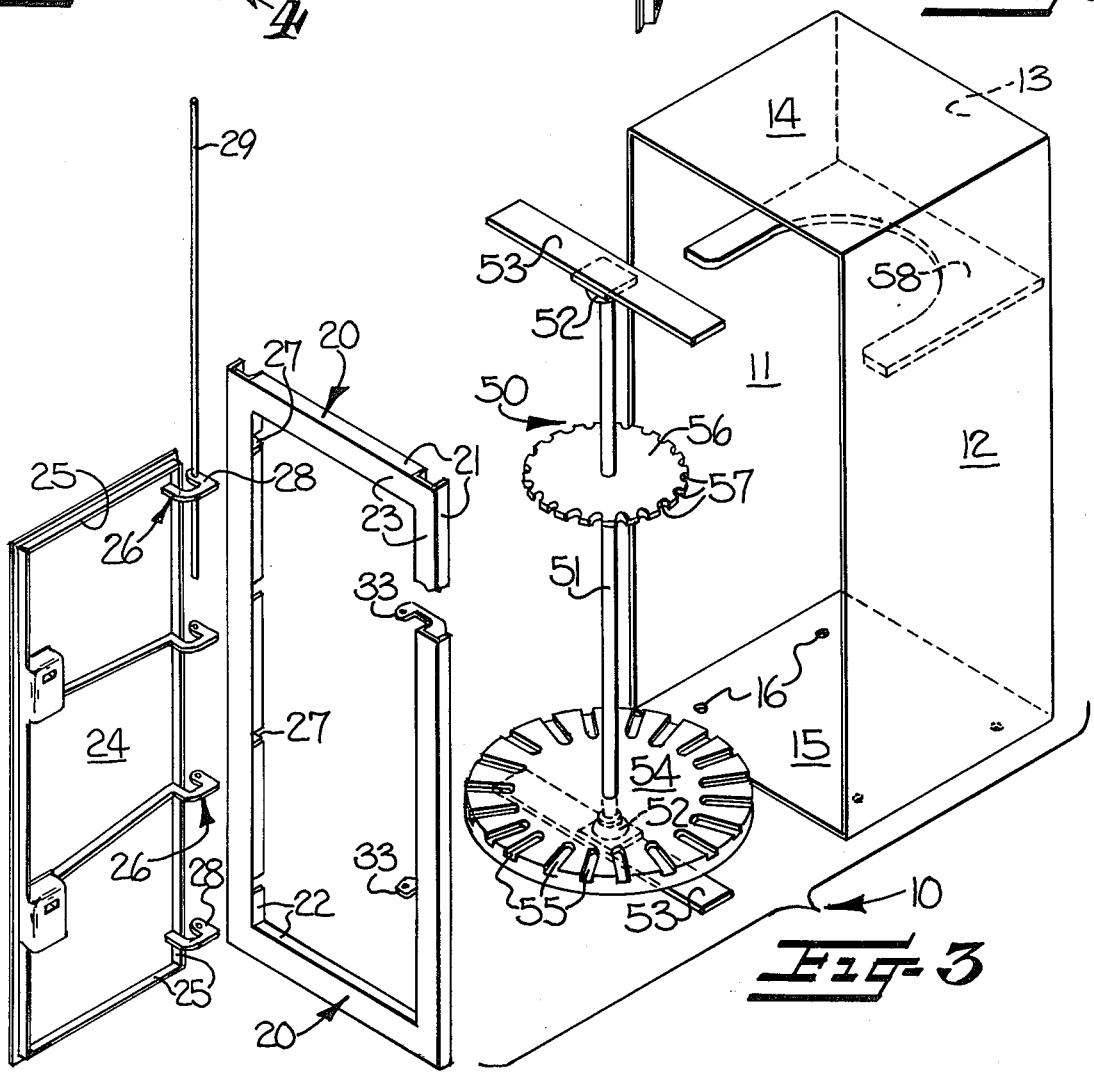
FIG. 3 is an exploded isometric view more clearly showing the component parts of the security cabinet.
Figure 4:
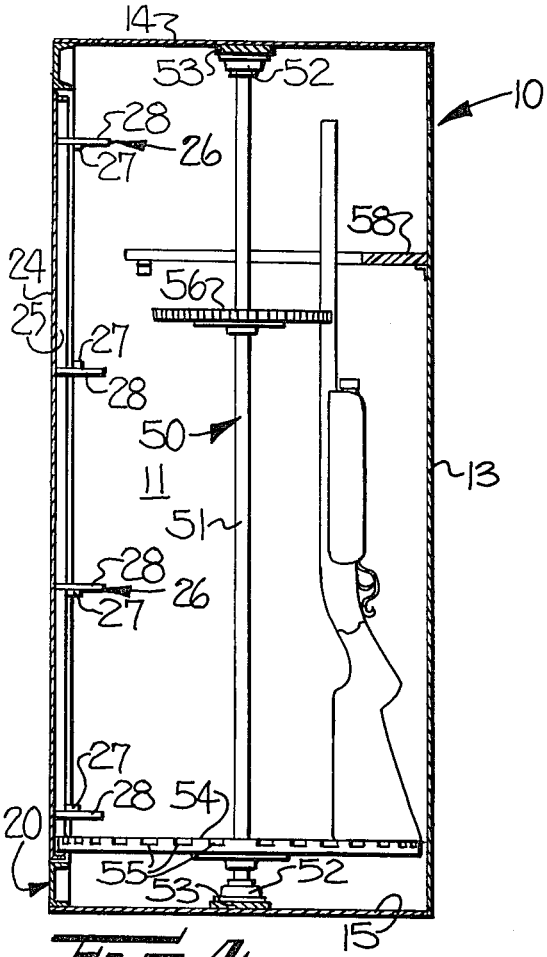
FIG. 4 is a vertical sectional view of the cabinet taken substantially along the line 4—4 of FIG. 1.

As illustrated in FIG. 3, a rotatable gun rack, generally indicated at 50, is provided interiorly of the cabinet to support the guns housed therein. The gun rack 50 includes an elongate upright shaft 51 with bearing blocks 52 mounted to reinforcing plates 53 carried by the upper and lower walls 14, 15 of the enclosure 10. The shaft 51 is thus mounted for rotation in the enclosure 10. A circular gun butt support 54 is carried by the shaft 51 adjacent the lower end thereof and is adapted for rotation with the shaft in the enclosure. The gun butt support includes a series of spaced recesses 55 in the upper face thereof adjacent the periphery of the circular support for receiving and supporting the butt portions of respective guns therein. The gun butt support 54 is of a diameter substantially corresponding to the inside dimensions of the enclosure and thus extends substantially across the enclosure with forwardmost portions of the gun butt support 54 overlying the bottom channel member of the door frame 20 to thus utilize to the maximum extent all of the interior space within the cabinet. The gun rack 50 also includes a gun barrel support 56 carried by an upper portion of the shaft 51 for rotation therewith inside the enclosure. The gun barrel support 56 is of smaller dimensions than the gun butt support 54 annd has a series of recesses 57 formed in the periphery thereof corresponding to the recesses 55 in the gun butt support 54 and serving to support the barrel portions of respective guns positioned therein.

As illustrated, the gun barrel support 56 is of circular shape and the recesses in both the gun barrel support and in the gun butt support extend entirely around the respective supports and form respective circular series of recesses for supporting guns therein. The gun support 50 may be readily rotated in the enclosure to provide access to any of the guns on the gun rack. A supplemental shelf 58 extends along the rear and side walls of the enclosure in the upper portion thereof to support smaller valuables or ammunition. It will be seen that the supplemental shelf makes use of otherwise wasted space in the corners and sides of the upper portions of the cabinet.

Figure 5:
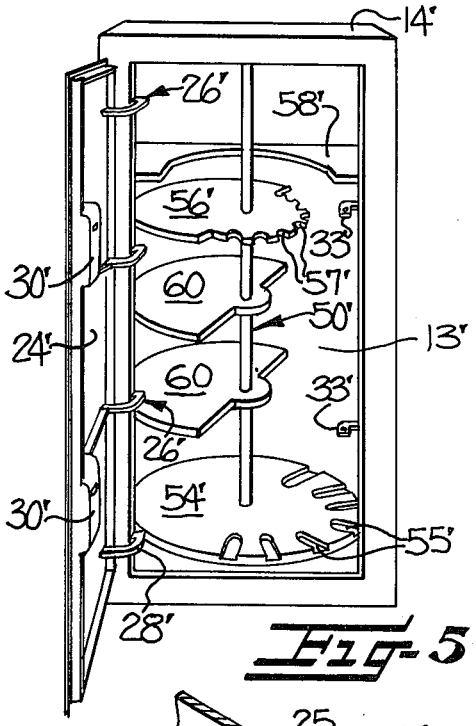
FIG. 5 is a front perspective view showing the interior configuration of the security cabinet in accordance with the second form of the invention.

In accordance with an alternate form of the invention, as illustrated in FIG. 5, the rotatable gun rack may be provided with rotatable shelves over a portion thereof and to support a fewer number of guns. To avoid repetitive description with reference to this form of the invention, parts previously described with reference to the first form of the invention will bear the same reference characters with prime notation added where applicable. Referring more particularly to FIG. 5, it will be seen that the gun barrel support 56' including a semi-circular portion of a diameter substantially less than the diameter of the gun butt support, and a semi-circular shelf portion on the opposite side thereof of a diameter substantially corresponding to the diameter of the gun butt support. The recesses 57' in the periphery of the gun barrel support 56' are located in the reduced diameter portion thereof, and corresponding recesses 55' are provided therebelow in the gun butt support 54'. Additional intermediate half-shelves 60 may be provided between the gun barrel support and the gun butt support for supporting other valuable items thereon.

In the drawings and specification, there have been set forth preferred embodiments of the invention, and although specific terms are employed, they are used in a generic and descriptive sense only and not for purposes of limitation.

That which is claimed is:

1. A security cabinet of steel construction for storage of valuable articles such as guns and the like and comprising an upright generally rectangular enclosure having an open front and wherein all of the walls thereof are of plate steel construction and welded together at their proximal edges along the corners of the enclosure, a rectangular door frame weldably secured to the walls of the enclosure and comprising weldably connected channel members of U-shaped cross-section having a pair of legs and an interconnecting web portion with one of the legs of all of the channel members being weldably connected to the adjacent plate steel wall of the rectangular enclosure, the other legs of the channel members collectively defining a doorway, and the outer faces of the interconnecting web portions of said channel members collectively defining the outer face of the door frame, a plate steel door positioned in said door frame with the outer face of said door being flush with the outer face of said door frame and with the periphery of the door closely conforming with the doorway defined by the door frame, hinge means located interiorly of the enclosure and carried by one of the side channel members of the door frame, said hinge means comprising a plurality of pivotally mounted arms, and extending inwardly of the enclosure a predetermined distance and then outwardly in an arcuate manner with the outer ends of the pivotally mounted arms being weldably secured to inner portions of said door, and a locking bracket weldably secured to the side channel member of the door frame extending along the opposite side of the door from said hinges, said door having an opening therethrough on the side thereof adjacent said locking bracket and said locking bracket having portions extending inwardly from the channel member and other portions extending forwardly through said door opening, and locking means cooperating with the portion of said locking bracket extending through said door opening for securing the door in locked position.

2. A security cabinet according to claim 1 wherein said plate steel door includes a series of longitudinal reinforcing members weldably secured to the inner face of the door and extending adjacent the periphery thereof, and said outer ends of said arms being weldably secured to said reinforcing members.

3. A security cabinet according to claim 1 wherein said pivotally mounted arms extend inwardly of the enclosure a distance of at least twice the length of the leg of said channel member and then extend outwardly in an arcuate manner toward the doorway, with the outer ends of the pivotally mounted arms being weldably secured to inner portions of said door at locations spaced inwardly from the side edge of the door.

4. A security cabinet according to claim 1 wherein said hinge means includes a plurality of mounting blocks positioned between the legs of said one channel member and being weldably secured thereto, and an elongate shaft extending longitudinally of said one channel member between the legs thereof and extending through said mounting blocks and the respective arms and serving to pivotally secure the arms to the respective mounting blocks.

5. A security cabinet according to claim 4 wherein said plurality of arms comprise upper, lower and a plurality of intermediate arms, said upper and at least one of said intermediate arms being positioned overlying their respective mounting blocks and supported thereby and thus serving for bearing the weight of the door while hingedly securing the door to the door frame, and the remaining arms being positioned underlying their respective mounting blocks and serving to assist in hingedly securing the door to the door frame.

6. A security cabinet according to claim 1 including a rotatable gun rack mounted in said enclosure, said gun rack including an elongate upright shaft, means at opposite ends of the shaft for mounting the shaft for rotation in said enclosure to the upper and lower walls of the enclosure, a circular gun butt support carried by said shaft adjacent the lower end thereof and adapted for rotation therewith in said enclosure, said gun butt support including a series of spaced recesses in the upper face thereof extending around the periphery of the circular support for receiving and supporting the butt portions of respective guns therein, said circular gun butt support being of a diameter substantially corresponding to the inside dimensions of the enclosure so as to extend substantially across the enclosure with forwardmost portions of the circular gun butt support overlying the bottom channel member of the rectangular door frame, and said gun rack also including a gun barrel support carried by an upper portion of said shaft for rotation therewith in said enclosure, said gun barrel support being of smaller dimensions than said gun butt support and having a series of recesses formed in the periphery thereof adapted for supporting the barrels of respective guns positioned therein.

7. A security cabinet of steel construction for storage of valuable articles such as guns and the like and comprising an upright generally rectangular enclosure having an open front and wherein all of the walls thereof are of plate steel construction and welded together at their proximal edges along the corners of the enclosure, a rectangular door frame weldably secured to the walls of the enclosure and comprising weldably connected channel members of U-shaped cross-section having a pair of legs and an interconnecting web portion with the legs of all of the channel members facing inwardly of the enclosure, one leg of each of the channel members being weldably connected to the adjacent plate steel wall of the rectangular enclosure, the other legs of the channel members collectively defining a doorway, and the outer faces of the interconnecting web portions of said channel members collectively defining the outer face of the door frame, a plate steel door positioned in said door frame with the outer face of said door being flush with the outer face of said door frame and with the periphery of the door closely conforming with the doorway defined by the door frame, said door including a series of longitudinal reinforcing members weldably secured to the inner face of the door and extending adjacent the periphery thereof, a plurality of hinges located interiorly of the enclosure and carried by one of the side channel members of the door frame, each of said hinges having a mounting block positioned between the legs of said one side channel member and weldably secured thereto, and an elongate curved arm pivotally secured to said mounting block and extending inwardly of the enclosure a predetermined distance and then outwardly in an arcuate manner with the outer end thereof being weldably secured to one of the longitudinal reinforcing members of said door, and a lockking bracket carried by the side channel member of the door frame on the opposite side from said hinges, said locking bracket having one end portion positioned between the legs of said side channel member and weldably secured thereto with portions extending inwardly from the channel member and a free end portion extending forwardly into the doorway and alongside said side channel member, said door having a recess therein located on the side of the door adjacent said locking bracket and an opening through the door located in said recess and with the free end portion of said locking bracket extending through said opening, and locking means located in said recess and cooperating with the free end portion of said locking bracket extending through said door opening for securing the door in locked position.

8. A security cabinet according to claim 7 wherein said locking bracket is formed of plate steel and wherein a facing material is provided on the portion of said locking bracket located directly behind the edge of the door, said facing material having a degree of hardness considerably greater than the steel of the locking bracket and thereby serving to prevent cutting the locking bracket in the event a saw blade was inserted into the narrow gap between the door and door frame.

9. A security cabinet according to claim 7 wherein the recess in said door comprises a generally rectangular opening formed in the plate steel door, and a rectangular plate steel box weldably secured to the inner face of the door behind said rectangular opening, a portion of the plate steel door extending beyond the side of the rectangular box to define an overlapping handle portion to facilitate grasping and opening said door, and the opening through which the free end portion of said locking bracket extends being located in the back wall of said rectangular box.

10. A security cabinet according to claim 7 including a pair of locking brackets carried by the side channel member of the door frame on the opposite side from said hinges and having respective free end portions extending forwardly into the doorway and alongside said side channel member, and said door having a pair of recesses therein with respective openings through the door located in said recesses and with the respective free end portions of said pair of locking brackets extending through the openings in said pair of recesses, and said locking means comprising respective locks cooperating with the free end portions of said locking brackets and being located in said pair of recesses.

11. A security cabinet according to claim 7 wherein the free end portion of said locking bracket which extends through the opening in said door has a hole therethrough, and wherein said locking means comprises a lock having a body with a recess in one side thereof adapted for receiving the free end portion of said locking member which extends through the opening in said door, and a key operated retractable pin located in said body and positioned for extending across the recess in said body and through the hole in the free end portion of said locking member positioned in said recess to thereby lockingly secure the lock to the locking member and securely maintain the door of the security cabinet in locked relation.

12. A security cabinet according to claim 11 including a collar carried by said door in said recess and closely surrounding the lock carried by said locking bracket and serving to prevent inserting a tool between the lock and the door for prying the lock to remove it from the door.

13. A security cabinet of steel construction for storage of guns and the like and comprising an upright generally rectangular enclosure having an open front and wherein all of the walls thereof are of plate steel construction and welded together at their proximal edges along the corners of the enclosure, a rectangular door frame weldably secured to the walls of the enclosure and comprising weldably interconnected channel members, each having one side portion weldably connected to the adjacent plate steel wall of the rectangular enclosure with the opposite side portions of the channel members collectively defining a doorway in the front of the enclosure, a plate steel door positioned in said door frame with the outer face of said door being flush with the door frame and with the periphery of the door closely conforming with the opening defined by the door frame, hinges carried by one of the side channel members of the door frame, said hinges being pivotally mounted and positioned interiorly of the enclosure and being weldably secured to proximal interior portions of said door, the hinges thus being inaccessible from outside the enclosure when the door is in the closed position, a rotatable gun rack mounted in said enclosure and including an elongate upright shaft, means at opposite ends of the shaft for mounting the shaft for rotation in said enclosure to the upper and lower walls of the enclosure, a circular gun butt support carried by said shaft adjacent the lower end thereof and adapted for rotation therewith in said enclosure, said gun butt support including a series of spaced recesses in the upper face thereof adjacent the periphery of the circular support for receiving and supporting the butt portions of respective guns therein, said circular gun butt support being of a diameter substantially corresponding to the inside dimensions of the enclosure so as to extend substantially across the enclosure with forwardmost portions of the circular gun butt support overlying the bottom channel member of the door frame, and said gun rack also including a gun barrel support carried by an upper portion of said shaft for rotation therewith within said enclosure, said gun barrel support being of smaller dimensions than said gun butt support and having a series of recesses formed in the periphery thereof corresponding to the recesses in said gun butt support and adapted for supporting the barrel portions of respective guns positioned therein, and said enclosure including a locking bracket weldably secured to the side channel member of the door frame extending along the opposite side of the door from said hinges, said door having an opening therethrough on the side thereof adjacent said locking bracket and said locking bracket having portions extending inwardly from the channel member and other portions extending forwardly through said door opening and locking means cooperating with the portion of said locking bracket extending through said door opening for securing the door in locked position.

14. A security cabinet according to claim 13 wherein said gun barrel support is of circular shape and the recesses in said gun barrel support and in said circular gun butt support form respective circular series of recesses for supporting guns therein.

15. A security cabinet according to claim 13 wherein said gun barrel support includes a semi-circular gun barrel supporting portion of a diameter substantially less than the diameter of said gun butt support and a semi-circular shelf portion on the opposite side thereof of a diameter substantially corresponding to the diameter of said gun butt support, said series of recesses in the periphery of said gun barrel support being located in the reduced diameter portion thereof.

* * * * *